US006598331B1

(12) United States Patent
Thibodeaux

(10) Patent No.: US 6,598,331 B1
(45) Date of Patent: Jul. 29, 2003

(54) SHOTGUN SIGHTING DEVICE

(76) Inventor: John R. Thibodeaux, 401 Mecca Dr., Lafayette, LA (US) 70508

( * ) Notice: Subject to any disclaimer, the term of this patent is extended or adjusted under 35 U.S.C. 154(b) by 0 days.

(21) Appl. No.: 10/058,202

(22) Filed: Jan. 29, 2002

(51) Int. Cl.[7] ..... F41G 1/46
(52) U.S. Cl. ..... 42/111; 42/124
(58) Field of Search ..... 42/124, 125, 127, 42/111

(56) References Cited

U.S. PATENT DOCUMENTS

| | | | | | |
|---|---|---|---|---|---|
| 1,190,121 | A | * | 7/1916 | Critchett | 42/119 |
| 1,756,603 | A | * | 4/1930 | Noske | 42/125 |
| 2,043,430 | A | * | 6/1936 | Doe | 42/125 |
| 2,054,090 | A | | 9/1936 | Marple | 33/245 |
| 2,367,762 | A | | 1/1945 | Eiane | 33/47 |
| 2,519,220 | A | | 8/1950 | Bentley | 33/252 |
| 2,585,345 | A | | 2/1952 | Procos | 33/261 |
| 3,260,008 | A | * | 7/1966 | Yeomans, Jr. | 42/111 |
| 3,365,801 | A | * | 1/1968 | De Simone | 42/127 |
| 3,886,667 | A | | 6/1975 | Rueb | 33/233 |
| 3,961,423 | A | | 6/1976 | Hrebar | 33/258 |
| 3,974,586 | A | | 8/1976 | Kappner | 42/1 |
| D248,310 | S | | 6/1978 | Hestehave | D22/8 |
| 4,561,204 | A | * | 12/1985 | Binion | 42/122 |
| 4,776,126 | A | * | 10/1988 | Williams | 42/125 |
| 4,841,659 | A | * | 6/1989 | Williams | 42/124 |
| 4,899,479 | A | * | 2/1990 | Sanders | 42/112 |
| 4,962,589 | A | | 10/1990 | LaRosa | 33/233 |
| 4,993,158 | A | * | 2/1991 | Santiago | 42/135 |
| 5,406,733 | A | * | 4/1995 | Tarlton et al. | 42/119 |
| 5,546,691 | A | * | 8/1996 | Allison | 42/90 |
| 5,941,006 | A | | 8/1999 | Horton | 42/101 |
| 6,336,285 | B1 | * | 1/2002 | Baumer | 42/124 |

* cited by examiner

*Primary Examiner*—Michael J Carone
*Assistant Examiner*—Denise J Buckley
(74) *Attorney, Agent, or Firm*—William W. Stagg

(57) ABSTRACT

A shotgun sighting device and method for sighting a shotgun with the eye of a gunner that is opposite the gun mounting shoulder of the gunner. The device is comprised of a linear sighting plane mounted by a plurality of bracket members to the barrel of a shotgun. The sighting plane has elongated mounting slots and for receiving mounting bolts for adjustably mounting the sighting plane to the bracket members in a position that is adjustably offset both horizontally and vertically from the barrel of the shotgun. The device provides a sighting plane for the gunner that is in alignment with the eye of the gunner that is opposite the gunner's gun mounting shoulder and thus provides a shotgun sighting aid for gunner's having impaired vision in their customary sighting eye.

4 Claims, 12 Drawing Sheets

SHOTGUN SIGHTING DEVICE

FIELD OF INVENTION

The present invention generally relates to the field of shotgun sighting devices and, more particularly, an apparatus and method for providing an offset sighting plane for use by a visually impaired shotgunner who must sight the shotgun with the eye opposite the shoulder upon which the gun is mounted.

BACKGROUND OF INVENTION

Typically, a right-handed shotgunner mounts the shotgun on his right shoulder, places his right cheek on the gunstock, and sights along the barrel of the shotgun with both eyes open. Such right-handed shotgunners are typically right-eye dominant. In such a case, the right eye controls the pointing of the gun barrel to allow the shotgun to align the barrel with the moving target. The opposite is true for left-handed shotgunners. A left-hand shotgunner is usually left-eye dominant. In that situation, the left-handed shotgunner mounts the shotgun on his left shoulder, places his left cheek on the gunstock, and sights along the barrel of the shotgun with both eyes open. The shotgunner's left-eye controls the orientation of the barrel with the moving target.

Shotgunners who become visually impaired in their dominant shooting eye, whether right or left, face serious difficulties when mounting and sighting a shotgun in a conventional manner. For example, a right-handed gunner who is visually impaired in the right eye or who is left eye dominant must attempt to align the shotgun barrel with the target by means of his left eye, which is offset from the line of the barrel. This offset creates a false line of sight when the shotgunner attempts to align the target with the end of the shotgun barrel resulting in the alignment being off to the left.

Depending upon the distance of the moving target from the shotgunner, the alignment of the barrel and the target perceived by the shotgunner with a dominant opposite eye can be several feet either ahead or behind of the moving target than the actual alignment, depending upon the direction of target flight. This perceived alignment would cause the shot placement to be several feet off from the target and resulting in the shotgunner missing the target with the shot. To compensate for this phenomenon, a visually impaired shotgunner must learn to mount and shoot the gun from the opposite shoulder. It is difficult and sometimes impossible for some shotgunners to obtain the skill and coordination necessary to shoot in that fashion. Consequently, many visually impaired shotgunners are prevented or discouraged from engaging in shotgun sports.

SUMMARY OF INVENTION

The present invention is intended to provide an apparatus and method to facilitate the ability of a visual impaired shotgunner to mount a shotgun in either the right-hand or the left-hand shoulder position, as desired, and to utilize the eye adjacent to the shoulder that is opposite the gun mounting shoulder to align the shotgun barrel with the target. Thus, the apparatus is intended for use by those individuals that suffer lost or impaired vision in their once dominant eye and who can no longer properly sight down a shotgun barrel for proper alignment of the barrel and the target. It is also intended for use by those shotgunners that are left-eye dominant but are right-handed shotgunners or those that are right-eyed dominant but left-handed shotgunners. For the purposes of this description of Applicant's invention the eye adjacent to the shoulder that is opposite the gun mounting shoulder of the gunner will be called the "opposite eye" and shotgunners whose dominant eye or unimpaired eye is adjacent to the shoulder that is opposite the gun mounting shoulder of the gunner will be called "opposite eye gunners".

The apparatus is comprised of a linear sighting plane to be mounted substantially parallel to a shotgun barrel in a manner that allows the sighting plane to be adjustably offset both horizontally and vertically with respect to the shotgun barrel. These horizontal and vertical offsets of the sighting plane from the shotgun barrel allow the sighting plane to be placed in alignment with the eye adjacent to the shoulder that is opposite the gun mounting shoulder of the gunner when the gunner is in shooting position, that is, the offsets allow the sighting plane to be placed in alignment with the opposite eye. Because the sighting plane of Applicant's apparatus can be adjusted both horizontally and vertically with respect to the linear gun barrel, the use of the apparatus allows an opposite eye gunner to place in alignment the sighting plane, the target and the gunner's opposite eye when the gunner places his cheek against the stock of the shotgun and, thus, facilitates a hit on the target when the shotgun is fired.

The sighting device is provided with sighting plane mounting brackets to hold the linear sighting plane in a desired offset position, both horizontally and vertically, with respect to the linear position of the barrel of the shotgun. This allows the user of the apparatus to adjust the position of the sighting plane with respect to the line of the shotgun barrel as desired in order to compensate for the physical differences that might be present between different shotgunners. For instance, because the distance between the centers of the two eyes of individual gunners may vary from gunner to gunner, the height of the opposite eye above the gun barrel when the gunner's head is tilted against the shotgun stock will vary from gunner to gunner. The apparatus allows for adjustments to be made on the alignment of the sighting plane to account for those differences.

Another feature of Applicant's invention is that the apparatus is reversible and thus may be positioned on either side of the shotgun barrel to accommodate both left-handed and right-handed gunners.

Still another feature of the apparatus is that it is readily attachable and detachable from the shotgun so that it may be moved from one shotgun to another or disassembled for storage.

Still another feature of the apparatus is that it allows a shotgunner to sight with his dominant eye even if the shotgunner chooses to use an opposite-handed gun. This occasionally occurs when a hunting outfitter provides the shotguns to be used on hunting trips. When semiautomatic shotguns are provided by an outfitter, left-handed shotguns for use by left-handed shotgunners or right-handed shotguns for use by right-handed shotgunners are often unavailable. Consequently, a shotgunner may be required to use an opposite-handed gun, that is a left-handed gunner may be required to use a right-handed shotgun or vice versa. A semiautomatic shotgun having side injection typically ejects spent shot shells and any associated powder residue to the side of the gunner away from the gunners face. An opposite-handed semiautomatic shotgun may eject spent shot shells and powder residue across the face of the gunner that can present a risk of harm to the gunner's eyes. Use of Applicant's apparatus on an opposite-handed shotgun will eliminate some of the risk associated with the ejected shot shells and powder residue produced by an opposite-handed shotgun because the gunner can mount the shotgun on the shoulder for which the shotgun is designed but still allow the gunner to sight with his dominant eye.

DESCRIPTION OF EMBODIMENTS

Figure 1:
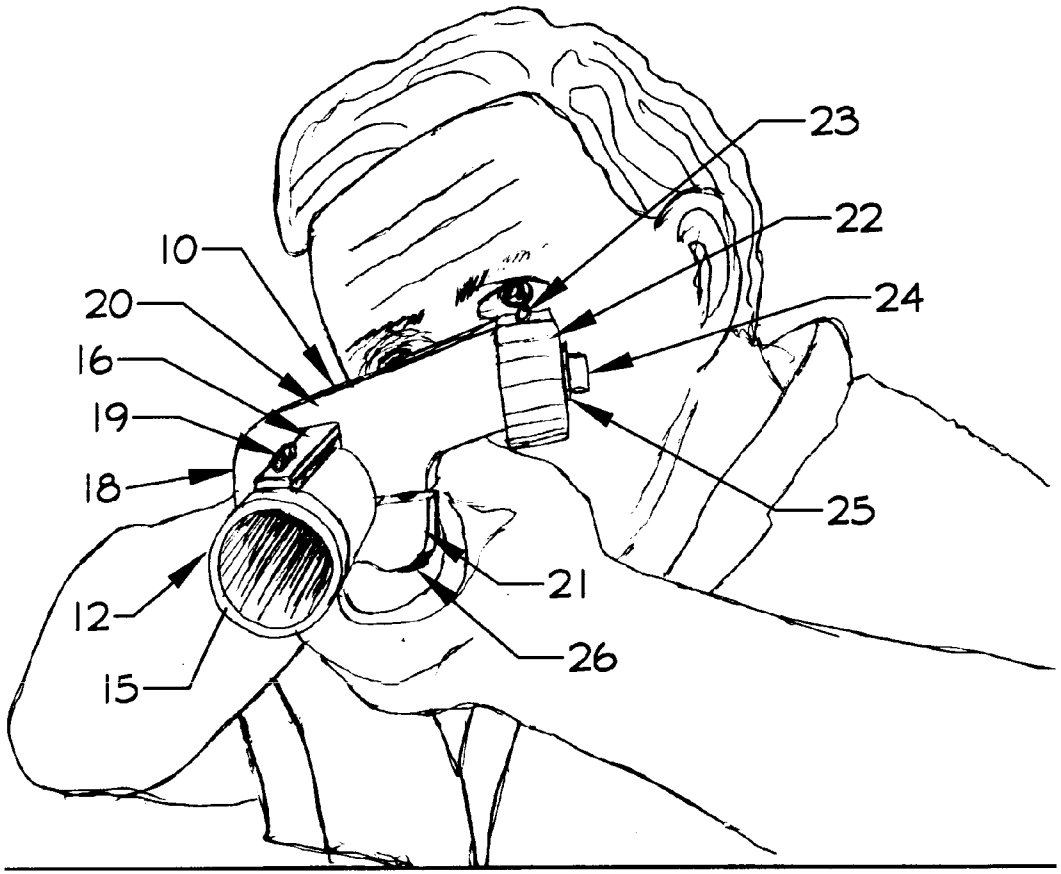
FIG. 1 is a front perspective view of a shotgunner utilizing the apparatus according to Applicant's invention.
Figure 2:
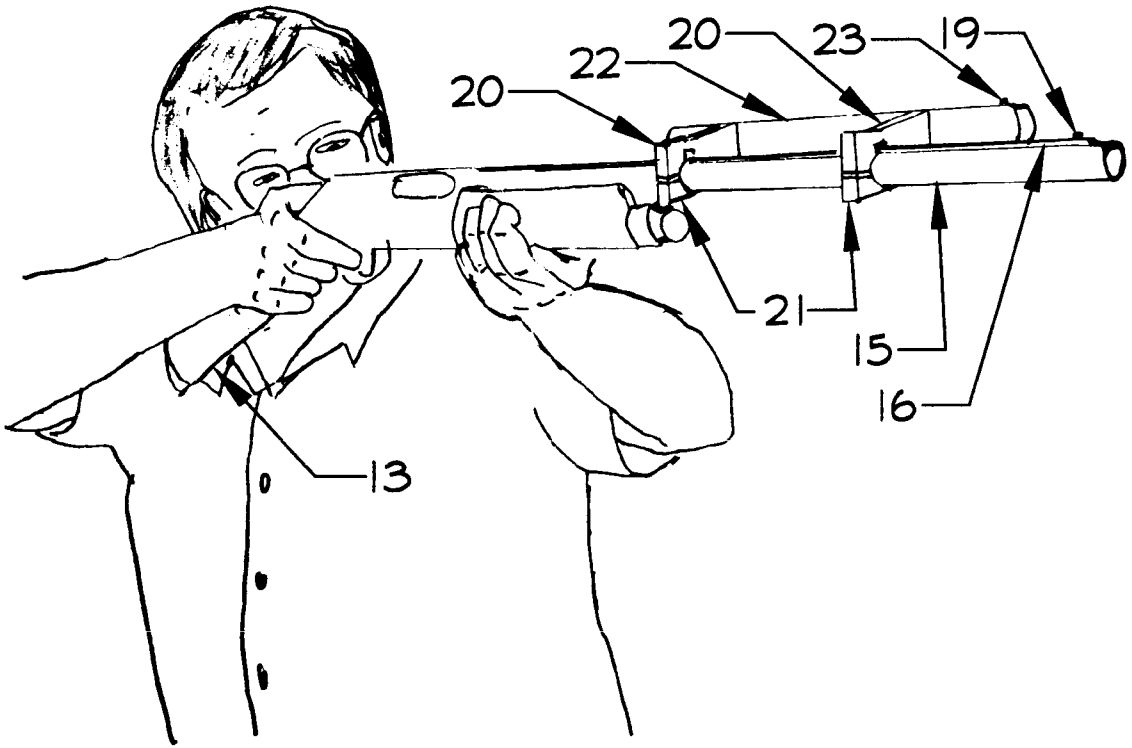
FIG. 2 is a side angled perspective view of a shotgunner using the apparatus according to Applicant's invention.

Referring now to the drawings and more particularly to FIG. 1, there is shown a front perspective view of an opposite eye gunner sighting a shotgun (12) utilizing the sighting apparatus (10) according to Applicant's invention. The shotgun sighting apparatus (10) has a linear sighting plane (22) that is mounted parallel to the barrel (15) by means of a plurality of mounting brackets (18). Each mounting bracket (18) is comprised of a top portion (20) and a bottom portion (21). The sighting plane (22) of the apparatus (10) is offset both horizontally and vertically from the barrel (15) of the shotgun (12). As shown in both FIG. 1 and FIG. 2, the horizontal and vertical offset of the sighting plane (22) from the barrel (15) allows the shotgunner to sight directly down along the sighting plane (22) with the eye adjacent to the shoulder that is opposite the gun mounting shoulder. In such a situation, the eye adjacent to the shoulder that is opposite the gun mounting shoulder is typically the dominant eye of the shotgunner and it is this eye that controls the alignment of the sighting plane (22) with a target.

In a customary and conventional shooting position, with the gunstock (13) positioned on the gunner's shoulder, the gunner's cheek is typically positioned against the side of the gunstock (13). When the gunner's cheek is so positioned, the gunner's head must be slightly tilted toward the gunstock (13). It has been determined that the interpupillary distance, the separation between the centers of the eyes, is normally between 58 mm and 72 mm ($2\frac{5}{16}$ inches and $2\frac{13}{16}$ inches) in adults. When sighting a shotgun in the conventional manner, the gunner's head is tilted back and to the side to place the gunner's cheek against the gunstock. When the gunner's head is so positioned, the adjacent eye of the gunner is aligned along the gun barrel and the opposite eye of the gunner is raised vertically slightly above the top of the gun barrel and is offset horizontally from the line of the gun barrel.

When the apparatus (10) is employed on a shotgun for use by an opposite eye gunner, the horizontal and vertical offsets of the sighting plane (22) required the gunner place his cheek in the proper position against the gunstock (13) to properly align the eye on the opposite side of the cheek, in this case the sighting eye, with the sighting plane (22). The adjustable horizontal and vertical offsets of the sighting plane allow for selective positioning of the sighting plane (22) to allow for the gunner's opposite eye to be placed in alignment with the sighting plane (22) and thus encourage the gunner to place his head in a preferred shooting position. This results in more consistent sighting by the gunner with his opposite eye, which will produce more hits on the target.

Figure 3:
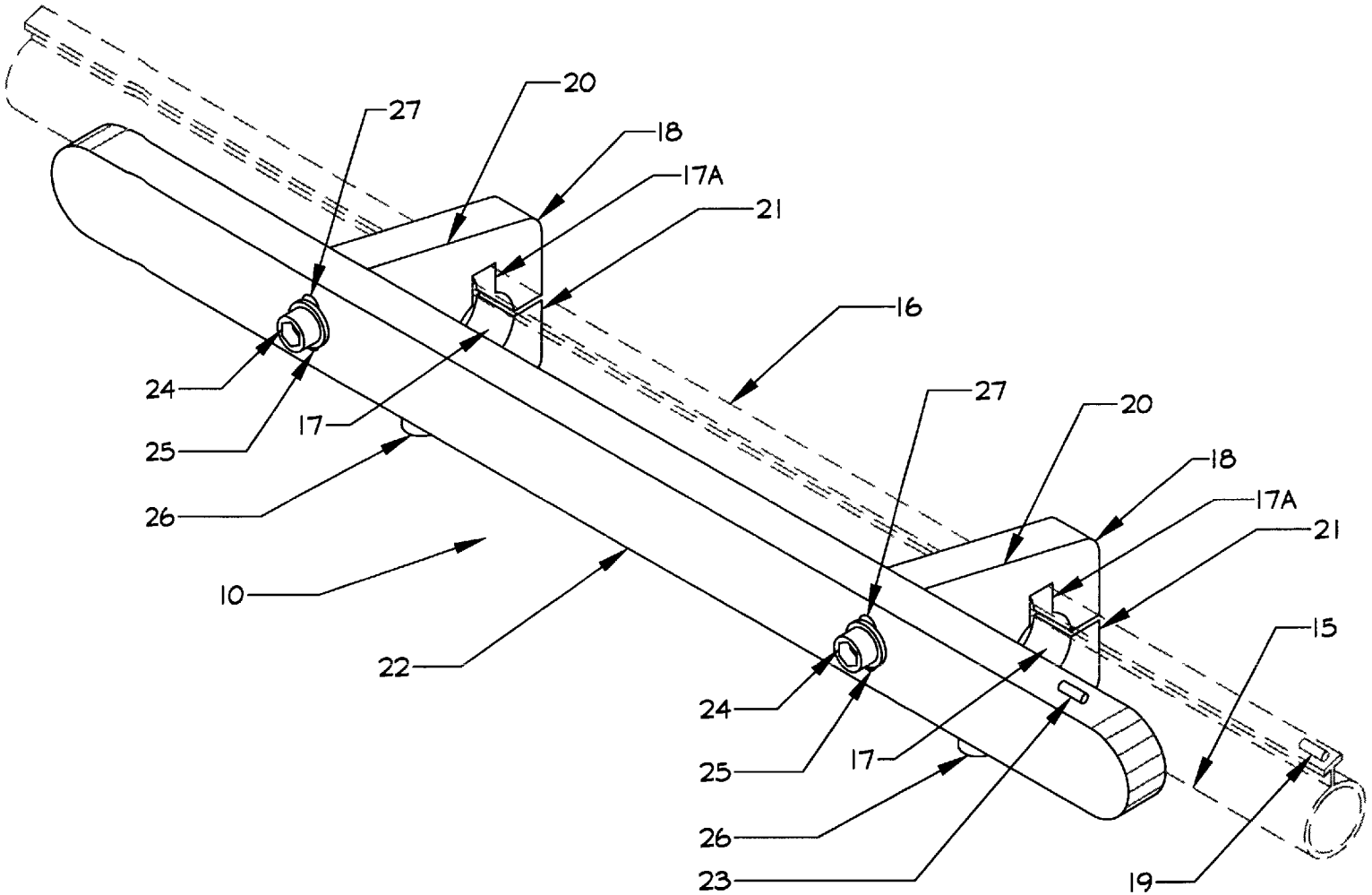
FIG. 3 is an isometric view of the apparatus of Applicant's invention.

FIG. 3, shows a perspective view of the apparatus (10) positioned for mounting on the right side of a shotgun barrel (15) by a pair of mounting brackets (18). Mounting brackets (18) are comprised on a top or upper bracket (20) and a lower or bottom bracket (21). Each upper bracket and each lower bracket has a substantially U-shaped segment (17) forming a saddle-like seat for fitting the upper bracket (20) and lower bracket (21) around the shotgun barrel (15). The upper bracket (20) is adapted for attaching the sighting plane (22) in a position parallel to and offset horizontally and vertically from the barrel (15). The U-shaped segment (17) may be adapted and sized to fit the varying gauges of shotgun barrels such as barrels designed for 12, 16, 20, 28 or .410 gauge shotshells. In addition, each upper bracket (20) may be provided with a notch (17A) to accommodate a sighting rib (16), which is common to many shotgun barrels. The notch may be eliminated from the upper mounting bracket (20) when the apparatus (10) is used with a barrel (15) not having a sighting rib (16). The various components of the apparatus (10) may be manufactured from plastics, polymers, steel or aluminum or any other suitable material or from combinations thereof.

The sighting plane (22) has a sighting bead (23) and slots (27) to facilitate its attachment to the mounting brackets (18) by means of mounting bolts (24) and lock nuts (25). The slots (27) are vertically orientated so that the vertical position of the sighting plane (22) above the barrel (15) may be adjusted along the length of the slots (27) as desired in order to accommodate physical variations between individual gunners or the gunner's preferences.

When the apparatus (10) is mounted on the right side of a shotgun (15) as shown in FIG. 3, a gunner may mount the stock (13) of a shotgun on his left shoulder and sight along the sighting plane (22) of the apparatus (10) with the gunner's right eye. This will allow a left-handed gunner to alight his right eye with the sighting plane (22) and gunner's target.

Figure 4:
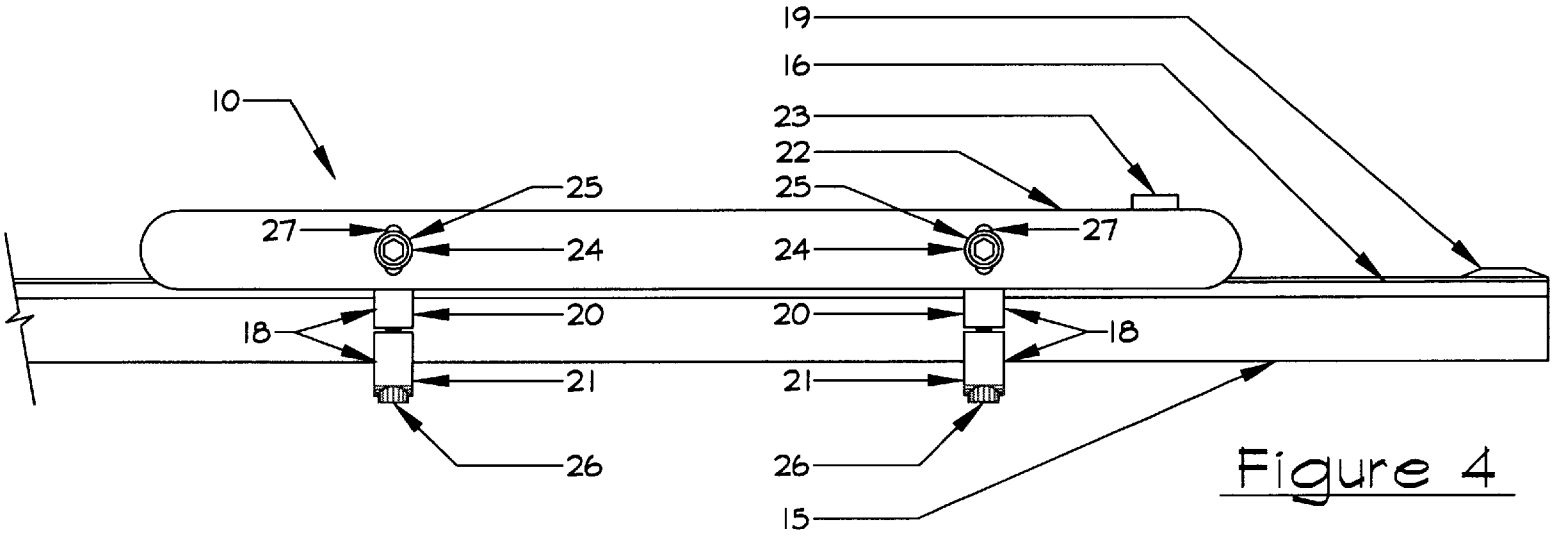
FIG. 4 is a side elevation of the apparatus shown in FIG. 3.
Figure 5:
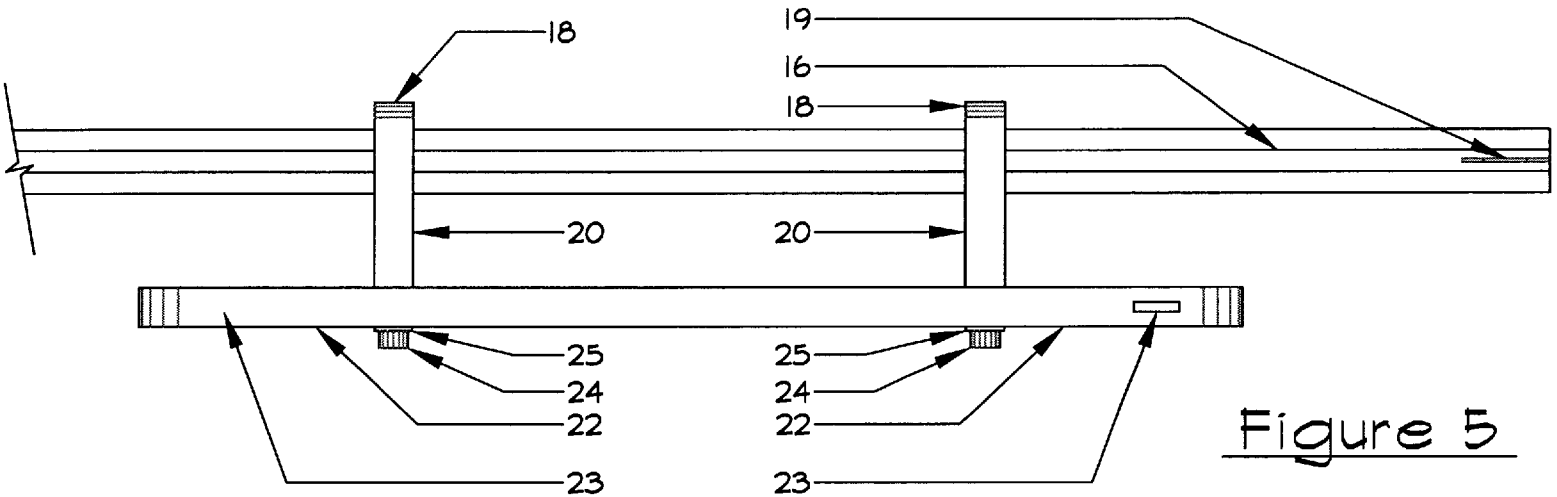
FIG. 5 is a top view of the apparatus shown in FIG. 3.

The apparatus (10) shown in FIG. 3 is shown in a side elevation view in FIG. 4 and in a top view in FIG. 5. The apparatus (10) is mounted to the shotgun barrel (15), as shown, by positioning the upper bracket (20) and the lower bracket (21) of each mounting bracket (18) around the barrel (15) and then holding each mounting bracket (18) in place by tightening the bracket bolts (26).

Figure 6:
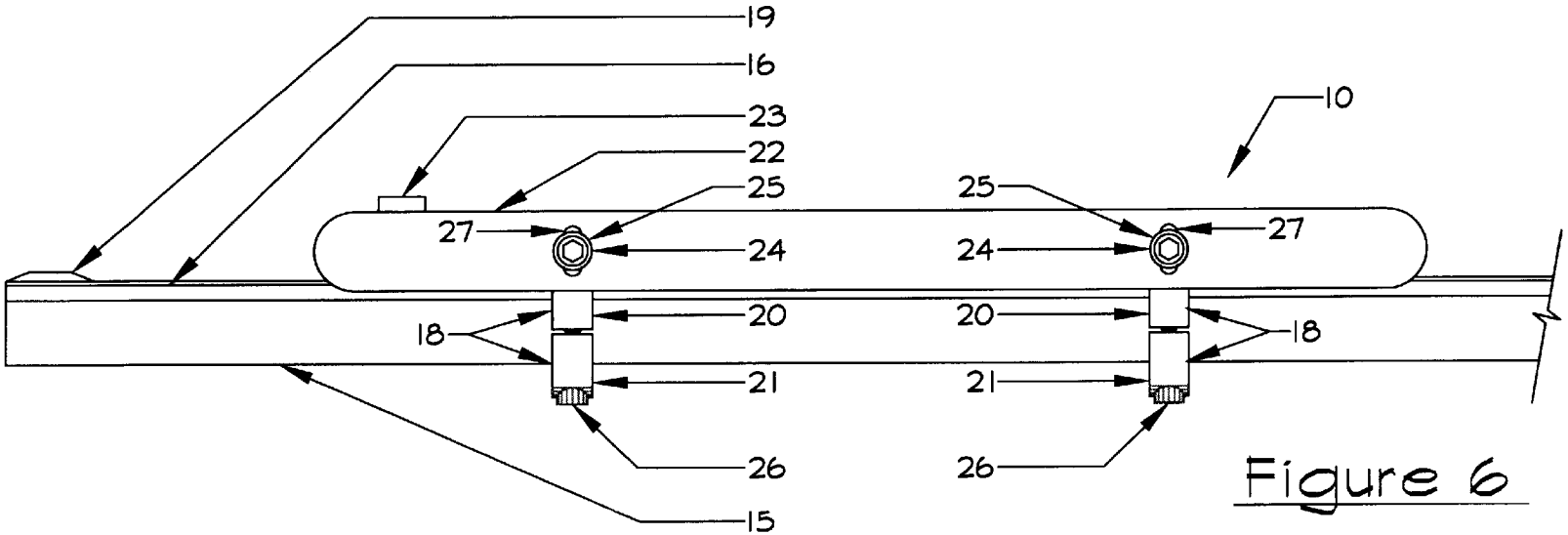
FIG. 6 is a side elevation view of the apparatus shown in FIG. 3 configured for an alternative mounting to that shown in FIG. 4.
Figure 7:
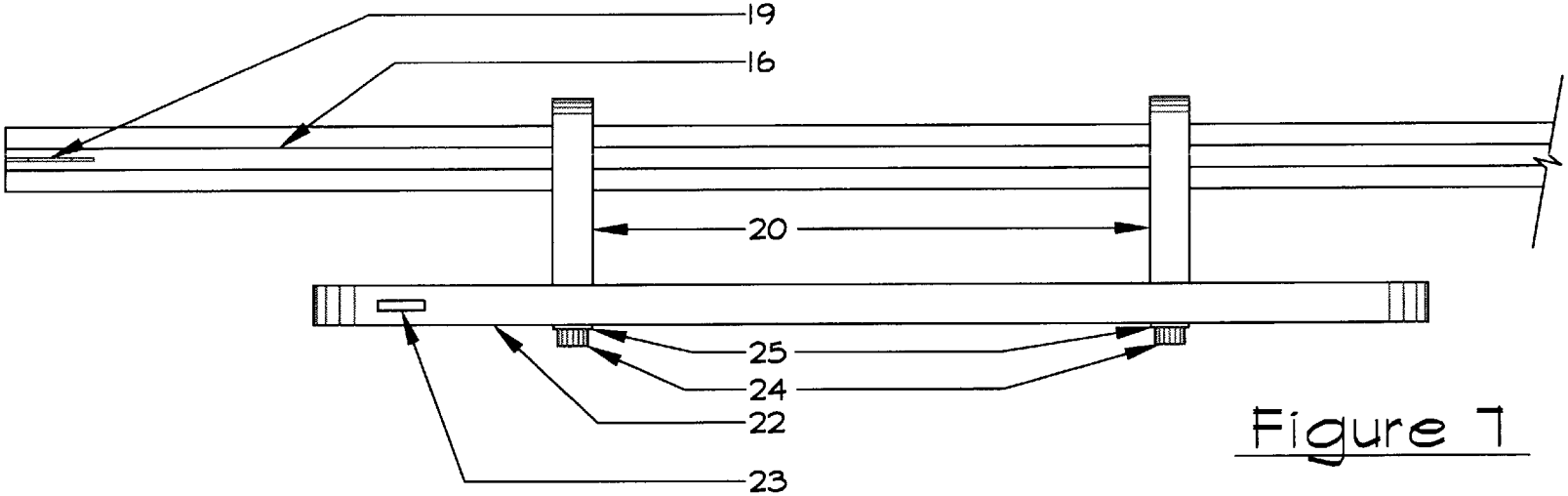
FIG. 7 is a top elevation view of the apparatus shown in FIG. 6.

As shown in FIG. 6, a left-side elevation view, and FIG. 7, a top view of FIG. 6, the apparatus (10) of Applicant's invention may be mounted and positioned on the left side of a shotgun barrel (15) for use by a right-handed gunner for sighting the shotgun with the gunner's left eye. When the apparatus (10) is used in the illustrated position by a right-handed gunner, the shotgun is mounted on the gunner's right shoulder, the gunner's right cheek is placed against the gunstock, and the gunner uses his left eye to sight along the sighting plane (22) to align the sighting plane (22) with a target. Whether mounted on the left side or the right side of the gun barrel (15, the height of the sighting plane (22) with respect to the top of the shotgun barrel (15), and any barrel rib (16), is adjustable by means of slots (27) on the side of the sighting plane (22) and the sighting plane mounting bolts (24) and washers (25).

Figure 8:
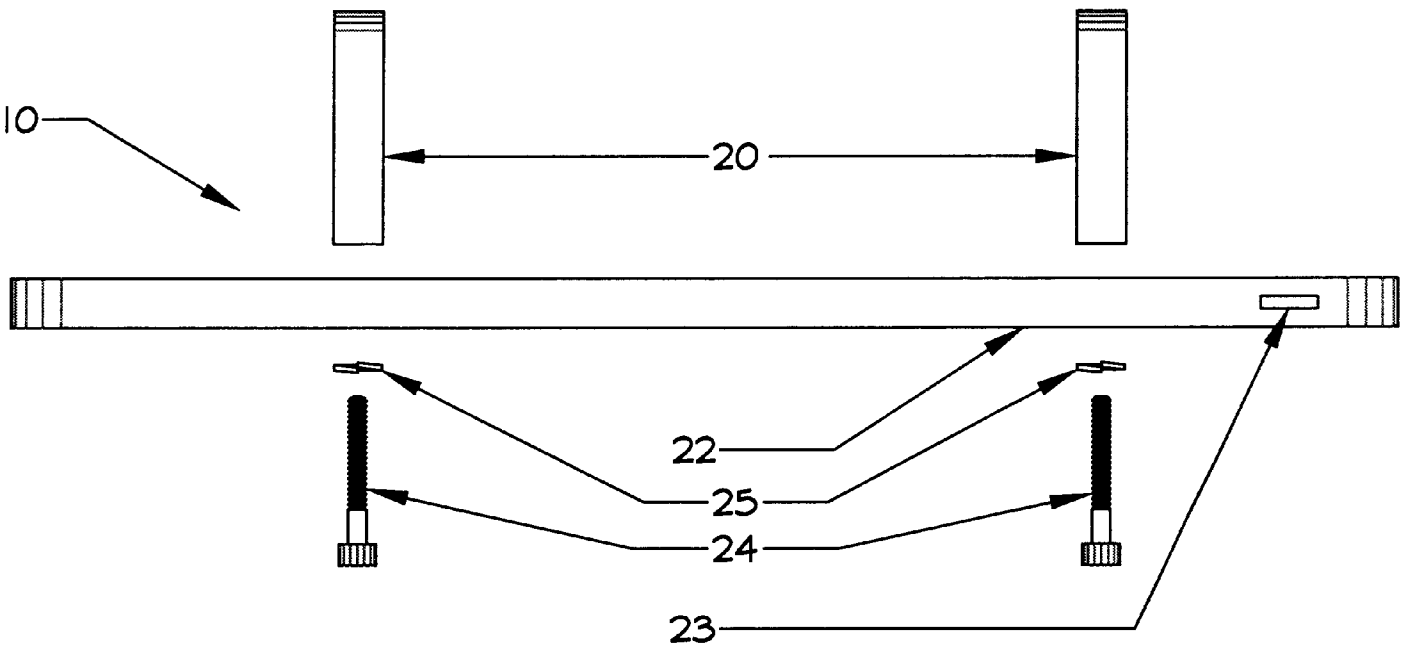
FIG. 8 is an exploded top view of the apparatus shown in FIG. 3.

FIG. 8 shows an exploded top view of the apparatus (10). The sighting plane (22) is attached to mounting brackets (18) by means of mounting bolts (24) having washers (25). The position of the sighting bead (23) with respect to the end of a shotgun barrel can be adjusted by turning the sighting plane (22) around.

Figure 9:
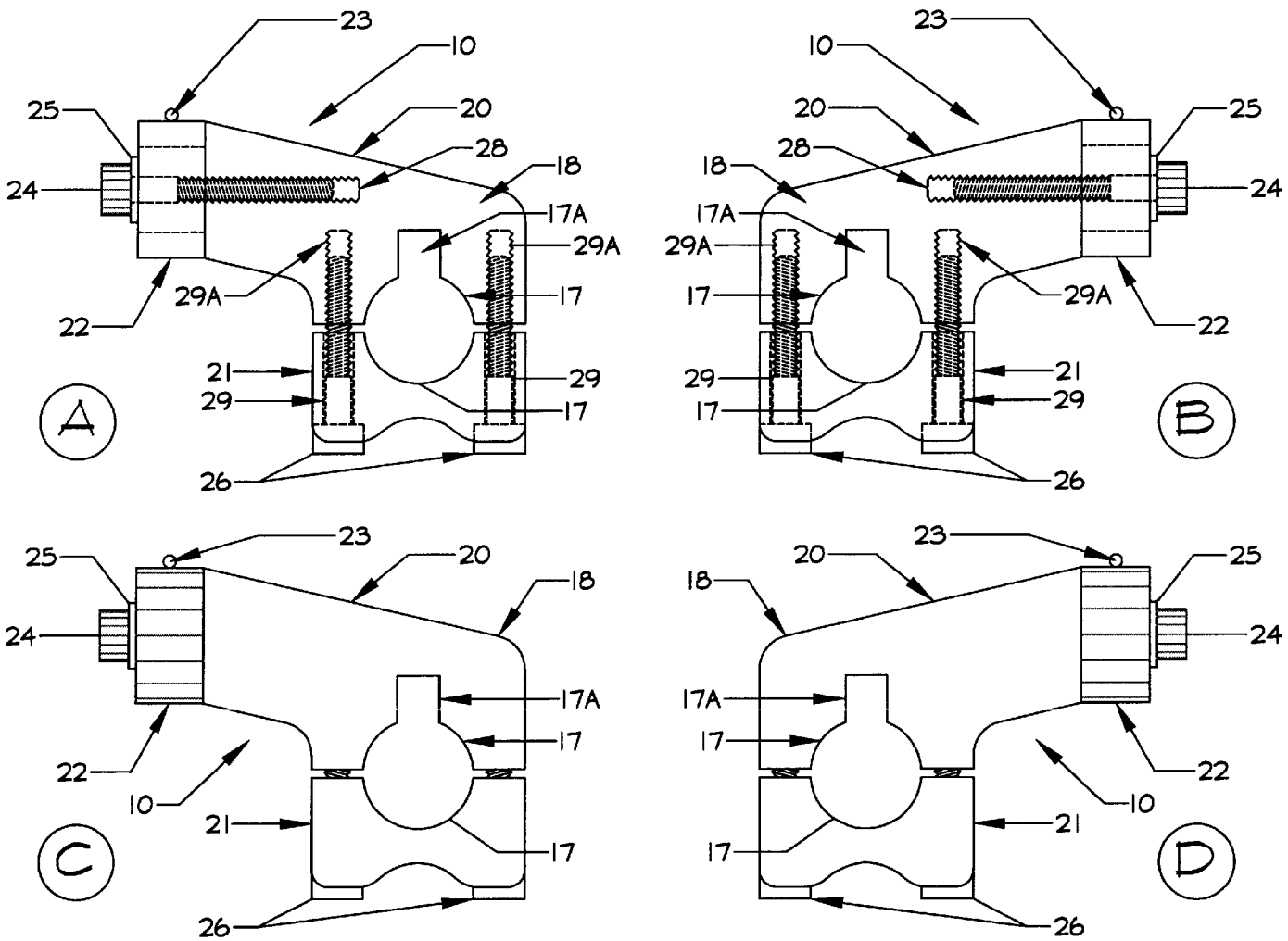
FIG. 9A is a cross-sectional view of the north side mounting position of the apparatus shown in FIG. 3.
FIG. 9B is a right side mounting position of the apparatus shown in FIG. 3.
FIG. 9C is an end view of the left side mounting position for the apparatus shown in FIG. 3.
FIG. 9D is an end view of the right side mounting position of the apparatus shown in FIG. 3.

FIG. 9A is a cross-section end view of a mounting bracket (18) positioned for mounting the sighting plane (22) having a sighting bead (23) on the left side of a shotgun barrel. The mounting bracket (18) is comprised of a top portion (20) and a bottom portion (21). The both the top portion (20) and the bottom portion (21) have a saddle-shaped area for conforming the bracket (18) around a desired shotgun barrel. A notch (17A) in the saddle (17) of the top bracket (20) as shown may be added when the bracket (18) is used on a shotgun barrel having a sighting rib.

The top portion (20) of the mounting bracket (18) has a substantially horizontal threaded hole (28) for receiving the bolts (24) used to mount the sighting plane (22) to the bracket. The top portion (20) and the bottom portion (21) of the mounting bracket (18) have mounting holes (29) and threaded mounting holes (29A) for receiving bracket mounting bolts (26) to hold and fix the mounting bracket (18) around a shotgun barrel.

FIG. 9B is a cross-section end view of a mounting bracket (18) positioned for mounting the sighting plane (22) having a sighting bead (23) on the right side of a shotgun barrel. As described in above, the top portion (20) and the bottom portion (21) of the mounting bracket (18) are fitted and held together around a gun barrel by means of bracket bolts (26) and mounting holes (29) and (29A). The sighting plane (22) is adjustably attached to the top portion (20) of the mounting bracket (18) by means of bolt (24) with washer (25) and threaded holes (28) in the upper portion (20) of the bracket (18).

FIGS. 9C and 9D illustrate, respectively, an end view of an apparatus (10) positioned for mounting on the left and right sides of a shotgun barrel.

Figure 10:
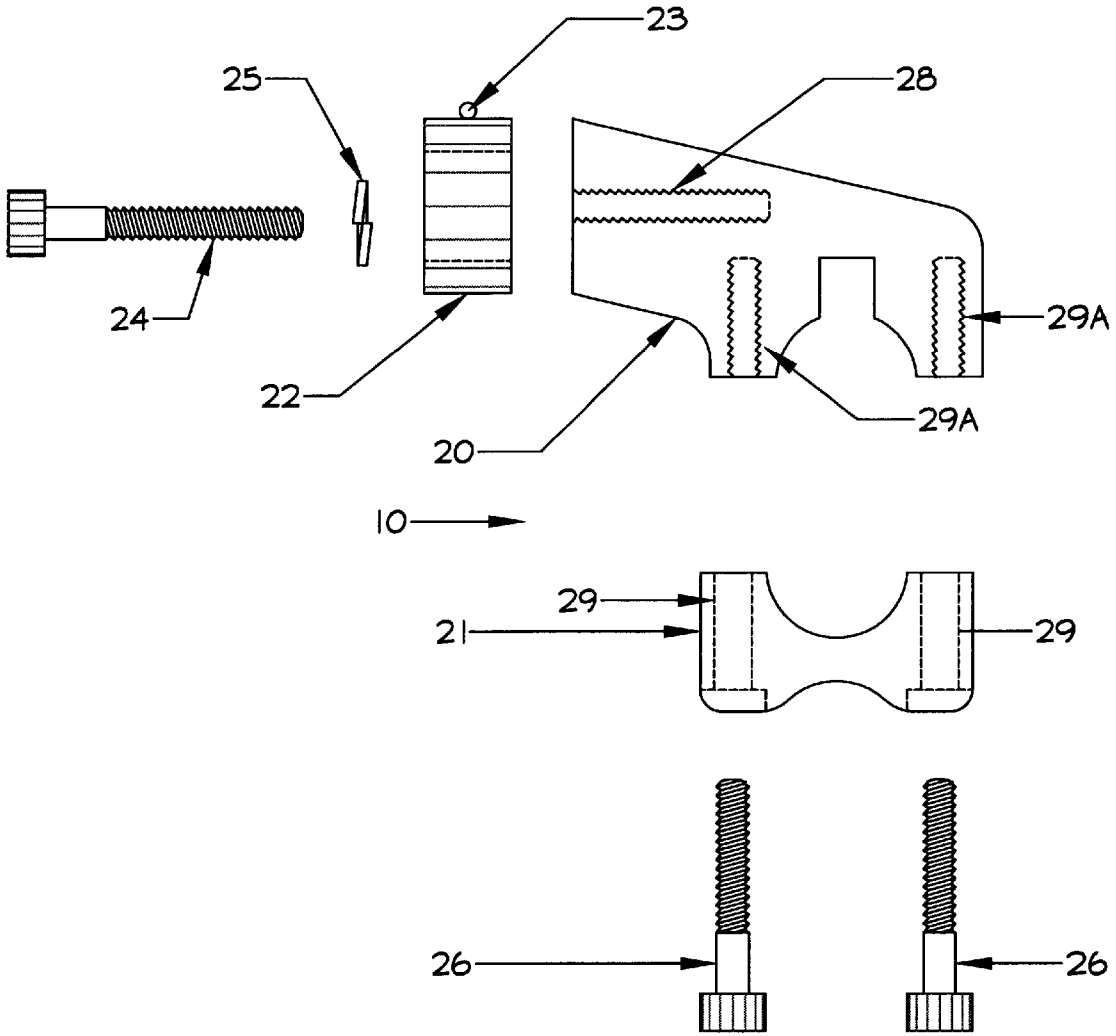
FIG. 10 is an exploded end view of the apparatus shown in FIG. 3 configured for left side mounting.

FIG. 10, a cross-sectional exploded view of the apparatus (10), illustrates the relationship between the various components of the apparatus. As can be seen the apparatus (10) may be readily and simply disassembled and re-assembled for use on different shotguns as may be desired.

Figure 11:
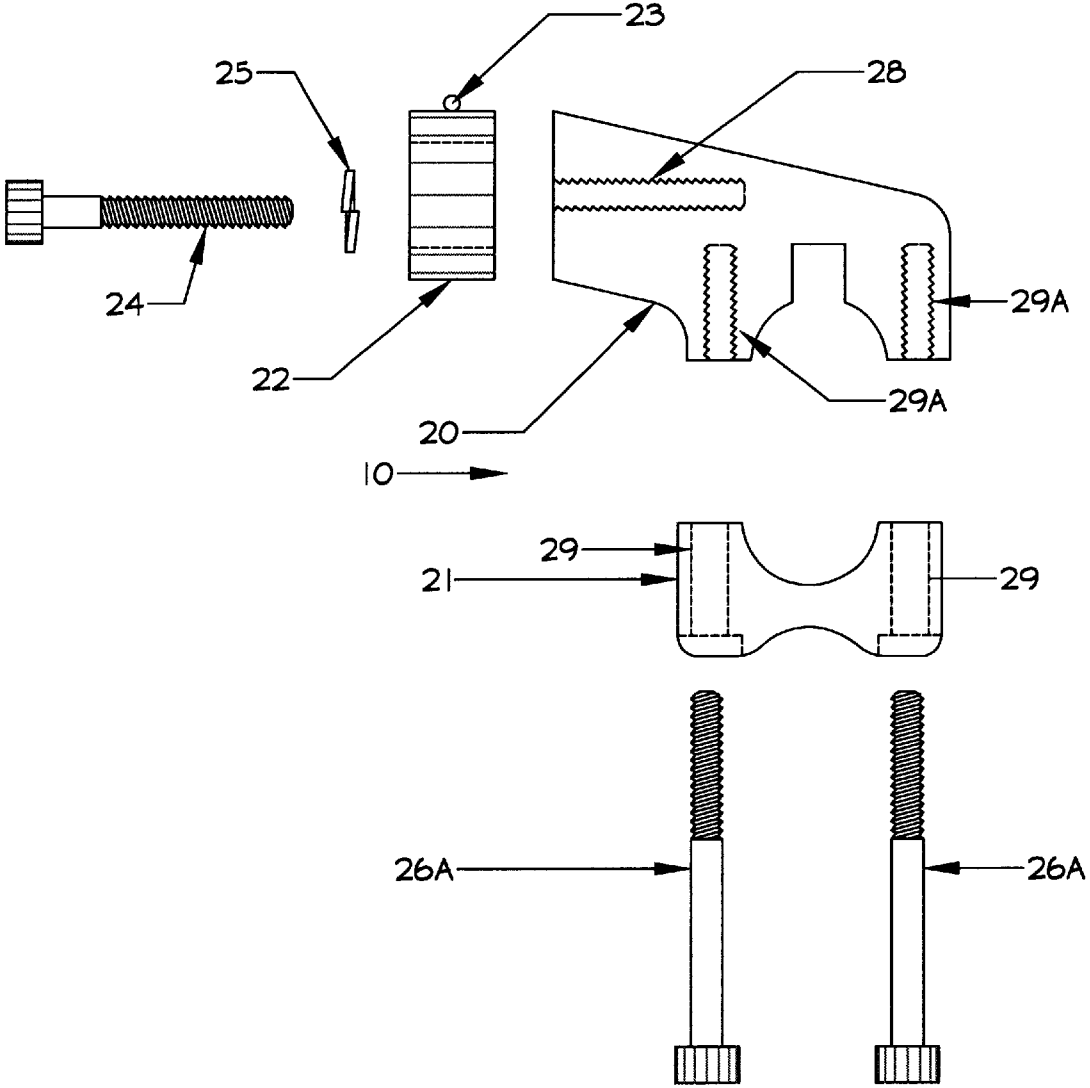
FIG. 11 is an exploded end view of the apparatus shown in FIG. 3 configured for mounting the apparatus on an over-and-under shotgun.

The apparatus (10) can be readily modified to accommodate its use on an over and under type shotgun. FIG. 11 is an exploded cross-sectional view of such a modification. In such a modification, the upper mounting bracket (20) and the mounting lower bracket (21) remain the same but in this the bracket mounting bolts (26A) are longer than the bolts (26) employed in the single barrel configuration. The longer mounting bolts (26A) are designed to accommodate the stacked barrel arrangement of two barrels in an over and under type shotgun. The mounting and positioning of the sighting plane (22) with the mounting bolts (24) remains the same as describe above.

Figure 12:
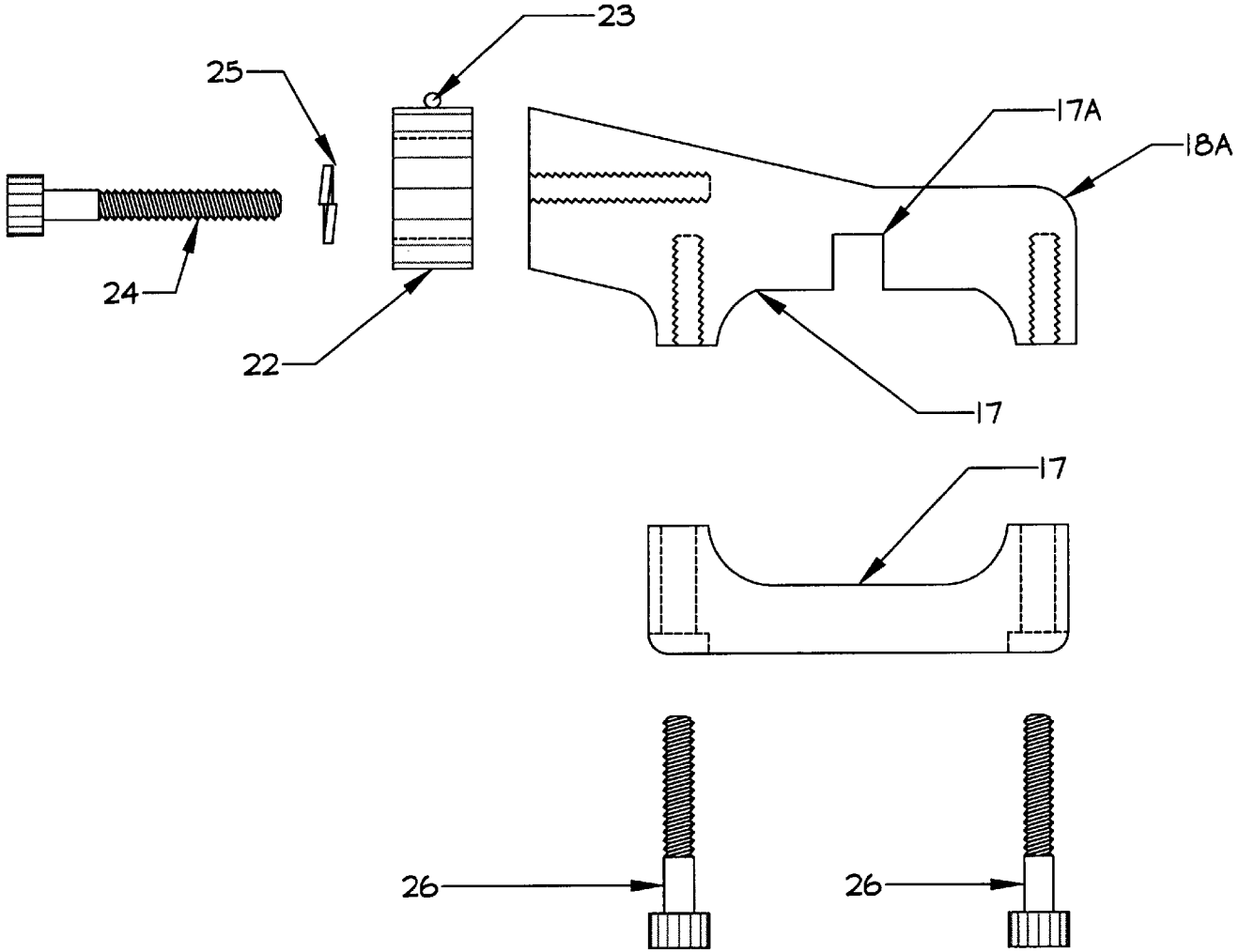
FIG. 12 is an exploded end view of the apparatus shown in FIG. 3 configured for mounting the apparatus on a side-by-side shotgun.
Figure 13:
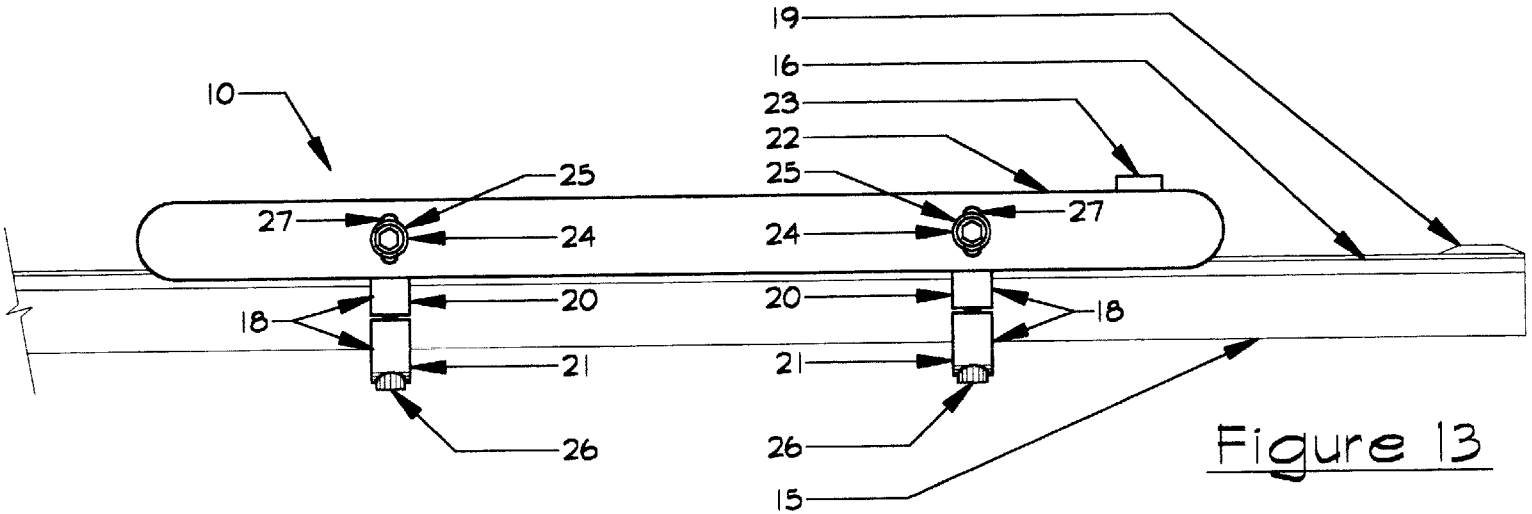
FIG. 13 is a side elevation view of the apparatus shown in FIG. 3 configured for mounting on a side-by-side shotgun.
Figure 14:
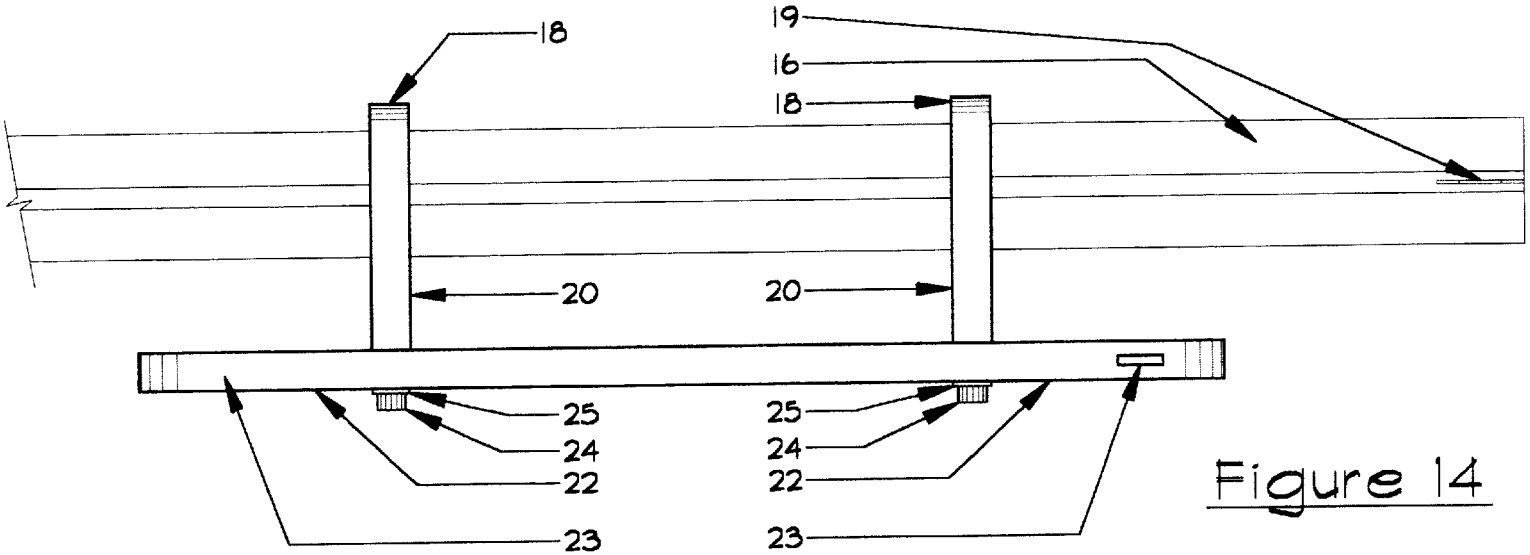
FIG. 14 is a top view of the apparatus shown in FIG. 13.
Figure 15:
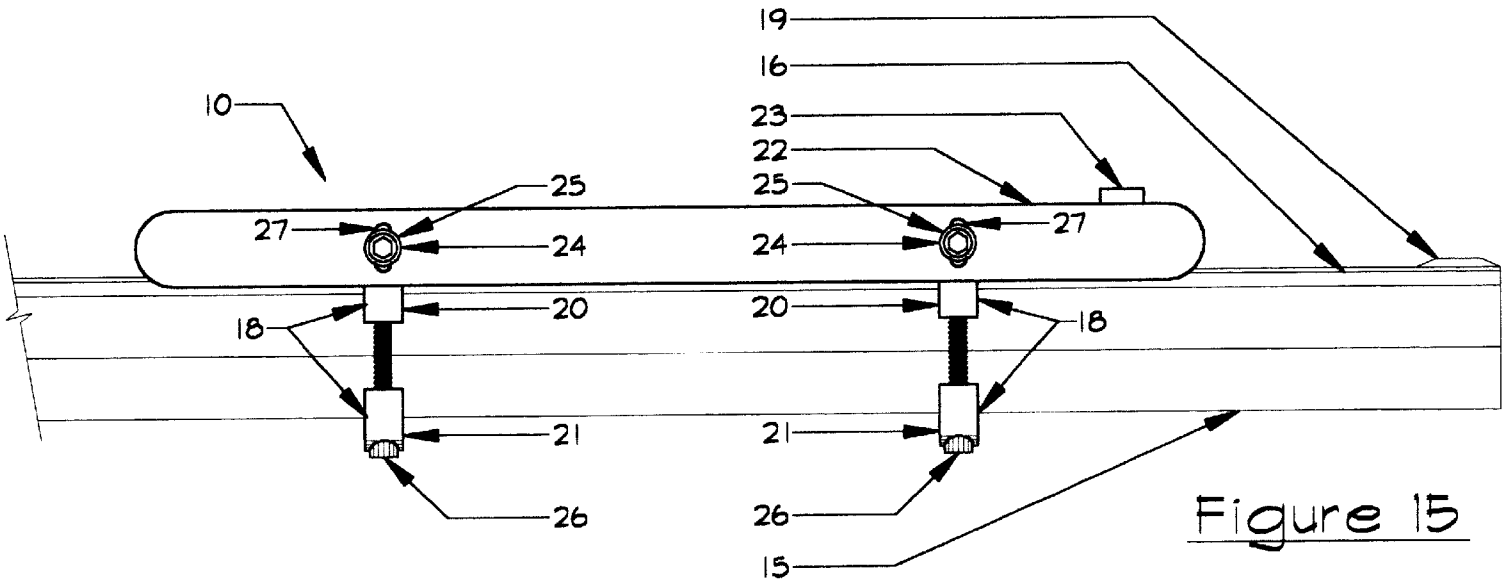
FIG. 15 is a side elevation view of the apparatus shown in FIG. 3 configured for mounting on an over-and-under shotgun.
Figure 16:
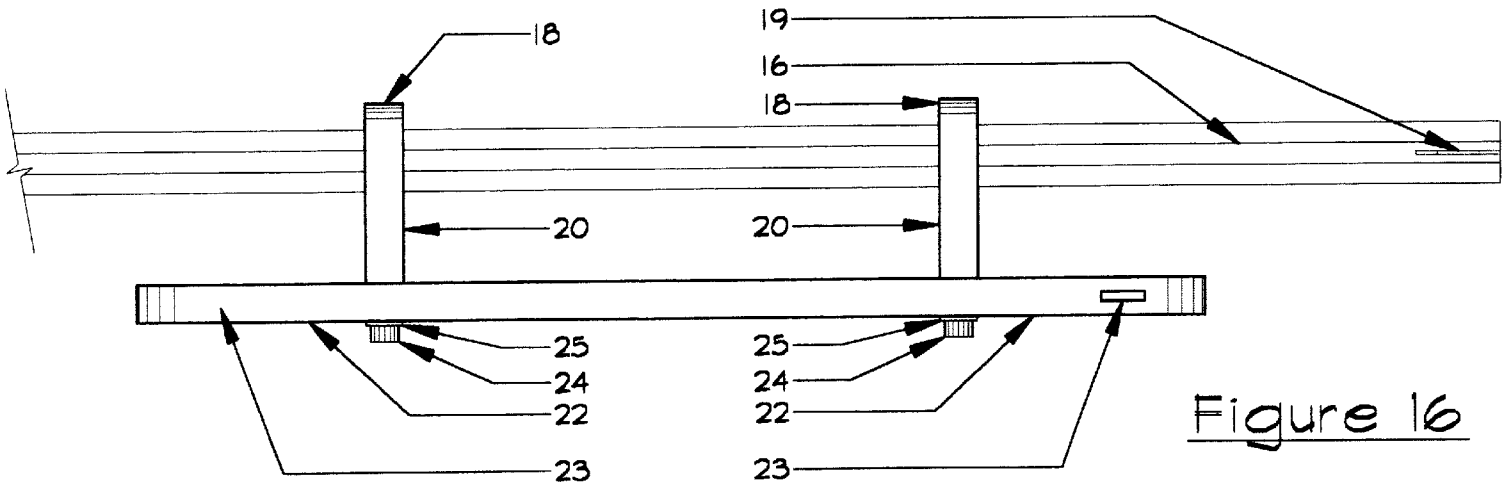
FIG. 16 is a top view of the apparatus shown in FIG. 15.

FIG. 12 is an exploded cross-sectional view of an alternate embodiment of the apparatus (10) modified to accommodate use of the apparatus (10) on a shotgun having a sideby-side type barrel arrangement. In this embodiment, the mounting bracket (18A) is widened to accommodate the side-by-side arrange of two barrels typically used in side-by-side shotguns. The mounting and positioning of the sighting plane (22) with the mounting bolts (24) remains the same as describe above. FIGS. 13 and 14 show top and elevation views of the apparatus (10) modified to accommodate use of the apparatus (10) on a shotgun having a side-by-side type barrel arrangement. FIGS. 15 and 16 show top and elevation views of the apparatus (10) modified to accommodate use of the apparatus (10) on a shotgun having an over-and-under type barrel arrangement.

It is thought that the shotgun sighting device of Applicant's invention and many of its attendant advantages will be understood from the foregoing description. One skilled in the art will appreciate that the present invention can be practiced by other than the described embodiments, which are presented for purposes of illustration and not limitation, and the present invention is limited only by the claims that follows.

I claim:

1. A method for sighting a shotgun with the eye of a gunner that is opposite the gun mounting shoulder of the gunner comprising the steps of:

(a) providing a shotgun, said shotgun having a stock section and a longitudinally disposed barrel section, said barrel section having a sighting rib running longitudinally along said barrel section;

(b) providing a longitudinally disposed sighting rod substantially parallel to said barrel section;

(c) providing a plurality of spaced apart bracket members, each of said bracket members having an upper bracket section and a lower bracket section, each upper bracket section and each lower bracket section having a U-shaped saddle portion conforming to the dimensions of said barrel section of said shotgun, each said U-shaped saddle portion of each said upper bracket section having a notch for receiving said sighting rib of said barrel section;

(d) providing means for adjustably mounting said sighting rod to said bracket members in a position that is offset both horizontally and vertically from said barrel of said shotgun whereby said sighting rod is in alignment with said eye of said gunner that is opposite said gun mounting shoulder of said gunner, said means for adjustably mounting said sighting rod to said bracket members includes the steps of providing a plurality of vertically orientated slots in said sighting rod; providing said plurality of spaced apart bracket members with a plurality of sight rod mounting holes; providing a plurality of sight rod mounting bolts; and adjustably attaching said sighting rod to said bracket members by positioning at least one of said mounting bolts in one of said mounting holes through one said vertically oriented slots at a desired position; and (e) adjusting said position of said sighting rod wherein said sighting rod is in alignment with said eye of said gunner that is opposite the gun mounting shoulder of said gunner when the cheek of said gunner is positioned against said stock section of said shotgun.

2. The method as recited in claim 1 wherein each said U-shaped saddle portion conforms to a shotgun barrel selected from the group consisting of 12, 16, 28, and 410 gauge shotgun barrels.

3. A shotgun sighting device, said shotgun having a barrel section having a sighting rib running longitudinally along said barrel section and a stock section for mounting said stock against the shoulder of a gunner, for sighting a shotgun with the eye of a gunner that is opposite the gun mounting shoulder of said gunner comprising:

(a) a longitudinally disposed sighting rod;

(b) a plurality of spaced apart bracket members, each of said bracket members having an upper bracket section and a lower bracket section, each said upper bracket section and each said lower bracket section having a U-shaped saddle portion conforming to the dimensions of said barrel section of said shotgun, each U-shaped saddle portion of said upper bracket section having a notch for receiving said sighting rib of said barrel section, and means for joining said upper bracket section to said lower bracket around said barrel section of said shotgun;

(c) means for holding each of said bracket members in a fixed position around said barrel section of said shotgun; and (d) means for adjustably mounting said sighting rod to each of said bracket members at a position that is offset both horizontally and vertically from said barrel of said shotgun whereby said sighting rod is in alignment with said eye of said gunner that is opposite said gun mounting shoulder of said gunner and wherein said sighting device may be selectively mounted on opposite sides of said barrel section of said shotgun whereby said sighting rod is in alignment with said eye of said gunner that is opposite the gun mounting shoulder of said gunner.

4. The device as recited in claim 3, further comprising a sighting bead positioned at a desired location on said sighting rod.

* * * * *